US006124834A

United States Patent [19]

Leung et al.

[11] Patent Number: 6,124,834

[45] Date of Patent: Sep. 26, 2000

[54] GLASS ANTENNA FOR RF-ION SOURCE OPERATION

[75] Inventors: Ka Ngo Leung, Hercules; Yung-Hee Yvette Lee, Berkeley, both of Calif.; Luke T. Perkins, Plainsboro, N.J.

[73] Assignee: The Regents of the University of California, Oakland, Calif.

[21] Appl. No.: 09/054,765

[22] Filed: Apr. 3, 1998

Related U.S. Application Data

[60] Provisional application No. 60/046,084, May 9, 1997, and provisional application No. 60/043,399, Apr. 4, 1997.

[51] Int. Cl.[7] ..... H01Q 21/00

[52] U.S. Cl. ..... 343/867; 343/895; 174/15.6; 427/49

[58] Field of Search ..... 343/867, 895; 174/15.6, 24, 68.3, 99 R, 110 R; 315/111.81, 111.91, 111.31, 111.41, 111.61; 427/49, 118; H01Q 21/00

[56] References Cited

U.S. PATENT DOCUMENTS

| | | | |
|---|---|---|---|
| 3,856,979 | 12/1974 | Schmid | 174/15.1 |
| 4,725,449 | 2/1988 | Ehlers et al. | 427/49 |
| 4,990,229 | 2/1991 | Campbell | 204/298.06 |
| 5,434,353 | 7/1995 | Kraus | 174/15.6 |
| 5,587,226 | 12/1996 | Leung et al. | 428/210 |

OTHER PUBLICATIONS

Y. Lee, et al. "Quartz antenna for radio frequency ion source operation", *Review of Scientific Instrunments,* vol. 69, No. 2, pp. 1023–1025, Feb. 1998.

*Primary Examiner*—Don Wong
*Assistant Examiner*—Hoang Nguyen
*Attorney, Agent, or Firm*—Coudert Brothers

[57] ABSTRACT

An antenna comprises a plurality of small diameter conductive wires disposed in a dielectric tube. The number and dimensions of the conductive wires is selected to improve the RF resistance of the antenna while also facilitating a reduction in thermal gradients that may create thermal stresses on the dielectric tube. The antenna may be mounted in a vacuum system using a low-stress antenna assembly that cushions and protects the dielectric tube from shock and mechanical vibration while also permitting convenient electrical and coolant connections to the antenna.

14 Claims, 6 Drawing Sheets

FIG._1
(PRIOR ART)
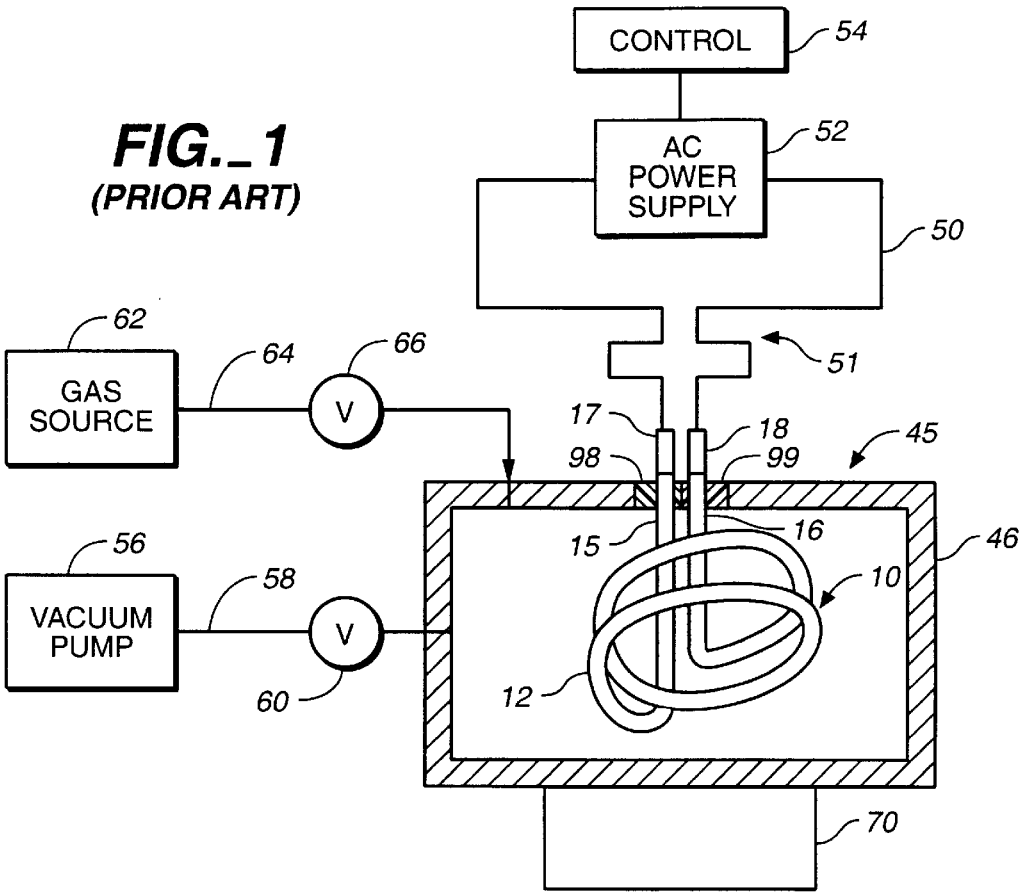
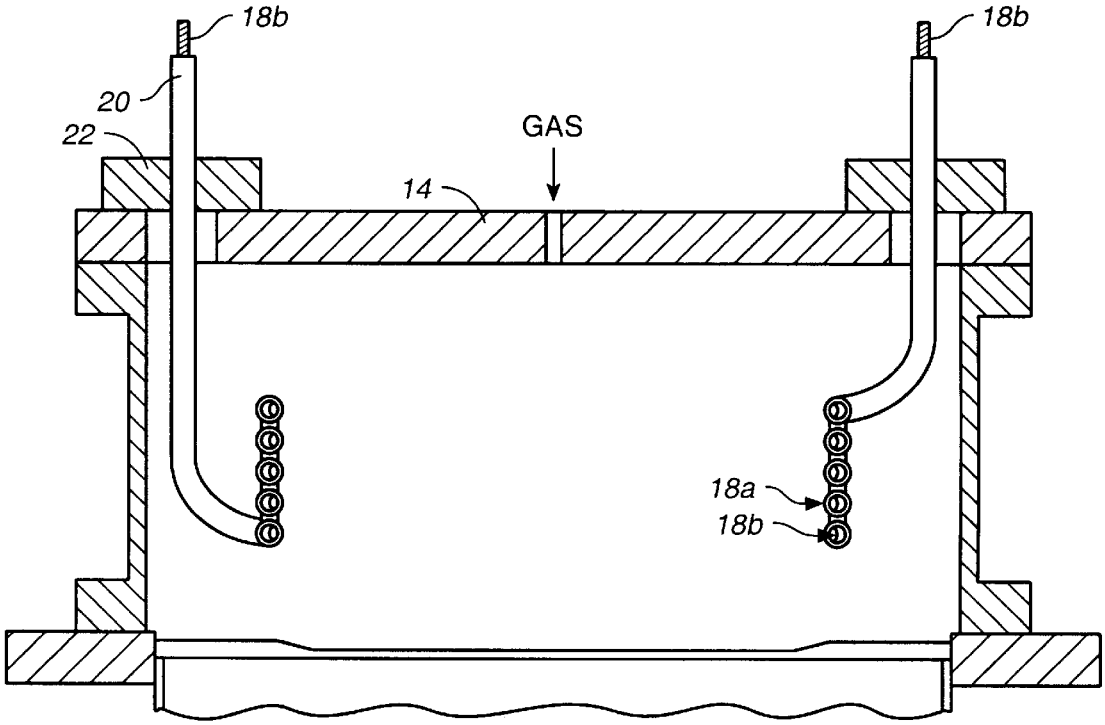
FIG._2 (PRIOR ART)

GLASS ANTENNA FOR RF-ION SOURCE OPERATION

This application claims the benefit of the provisional application entitled "Glass Antenna For RF-Ion Source" having provisional application number 60/043,399, filed Apr. 4, 1997, and incorporated herein by reference, and the provisional application entitled "Glass Antenna For RF-Ion Source" having provisional application number 60/046,084, filed May 9, 1997 and also incorporated herein by reference.

This invention was made with U.S. Government support under Contract No. DE-AC03-76SF00098 between the U.S. Department of Energy and the University of California for the operation of Lawrence Berkeley Laboratory. The U.S. Government may have certain rights in this invention.

FIELD OF THE INVENTION

The present invention relates to plasma and ion beam generation in general, and more particularly to ion and plasma source antennas. The invention is directed to an improved radio frequency drive antenna used to create a plasma from which ions are extracted.

BACKGROUND OF THE INVENTION

Ion sources are used in ion beam and neutral beam accelerators, spectrometers, for ion implantation, waste control of radioactive nuclear materials, and in plasma processing. Plasma processing encompasses the use of plasmas for surface treatment or surface modification including, but not limited to, ion implantation or coating of surfaces. Ion beams may also be useful for fusion. The positive or negative ions are generally obtained or extracted from a plasma formed from a gas. The plasma is created by exciting electrons in a vacuum chamber. The gas is ionized by electron bombardment, vacuum arc discharge, thermal filaments, or power coupled from a power source to the gas via an antenna. This invention relates to a new improved radio frequency drive antenna used to create a plasma from which ions are extracted.

An ion source for an accelerator or the like generally comprises a vacuum chamber in which a low pressure gas, such as hydrogen or deuterium, is ionized to produce an ionized gas plasma. It is often desirable to produce a plasma having a high ion density so that the accelerator may be supplied with a beam having a high density of charged or neutral particles, such as gas ions, atoms or molecules.

One common method of producing a high density plasma in an ion source is to provide thermionic cathode filaments which emit a copious supply of electrons, which then may be accelerated to produce an ionized gas plasma. This approach has the disadvantage that thermionic cathode filaments often have a very short operating life, e.g., only a few hours. Moreover, the electrically heated filaments produce considerable heat which may cause operating problems, such as outgassing from the filaments or from chamber walls.

Another method of producing a dense ionized plasma is to supply radio frequency power to the vacuum space. Generally, a small thermionic cathode filament is provided to emit electrons so that there is initial ionization of the ionizable gas, which then derives additional energy from the radio frequency power, causing additional ionization of the gas. The result is that a dense ionized gas plasma is produced. The power is supplied to the ion source by an antenna in the vacuum chamber. The RF power can be thought of as heating or increasing the energy level of the electrons so that a dense plasma is produced.

A prior art plasma ion source system is shown in FIG. 1. An ion source antenna 10 is installed in a volume plasma ion source 45 having a vacuum chamber or housing 46 within which the antenna 10 is mounted. The antenna has lead-ins 15 and 16 extending through seals 98 and 99. The terminals or contacts 17 and 18 are connected to an AC power supply circuit 50 through an impedance matching circuit 51. AC power supply circuit 50 includes an AC power supply 52. The power supply 52 may have a control circuit 54 for regulating the power supplied to the antenna. The RF frequency is typically in the range of two megahertz to 14 megahertz. However, RF frequencies lower than 500 kHz may be acceptable for ion implantation systems. The plasma ion source 45 typically also includes means within the vacuum chamber 46 for producing initial ionization. Such means may take the form of a small electron-emitting filament (not shown in FIG. 1). The power supplied by the plasma ion source antenna 10 then increases the level of ionization and produces a dense plasma within the vacuum chamber from which ions can be extracted to generate an ion beam.

A typical plasma ion source 45 also has means to generate a vacuum within the chamber. A vacuum pump 56 is connected to the vacuum chamber 46 by a vacuum line 58 which includes a regulating valve 60. The vacuum pump is operative to establish and maintain an appropriate vacuum level in the chamber 46. FIG. 1 also shows a plasma gas source 62, connected to the vacuum chamber 46 by a supply line 64 which includes a regulating valve 66. The gas source 62 may be a pressure tank containing the desired plasma gas, such as hydrogen, nitrogen, or others, to be ionized in the vacuum chamber 46, so as to produce the desired high density plasma.

As shown in FIG. 1, the plasma ion source 45 provides a copious supply of ions to a beam accelerator 70. The beam accelerator 70 may generate a beam of particles or ions which are either positively or negatively charged. The current of ions extracted from plasma ion source 45 is typically referred to as an "extracted current." The maximum extractable current is proportional to the plasma density. The extracted current generally increases as more RF energy is coupled to the plasma, which increases the density of the plasma. Some of the factors that influence the coupling of the RF antenna power to the plasma include the RF resistance of the antenna and whether or not (as described below) there are high-field short circuit paths that shunt RF power across the antenna coils. A common figure of merit in ion beam systems is the ratio of extracted ion current (mA) to the RF input power (kW).

Typically, the extracted ion current plateaus at a high RF input power because of deleterious effects that limit the actual RF power coupled to the plasma. When the antenna coil is made of bare metal, such as copper, sparking or arcing may occur in the vacuum chamber, both between the turns of the coil, and also between the coil and various electrodes which may be employed in the ion source. When the antenna coil is operated at high power levels, the RF voltage between different portions of the coil may be quite high. Moreover, electrodes may be employed in the ion source to produce accelerating voltages which are quite high, so that sparking or arcing may occur. The arcing and sparking that occurs during high RF power operation limits the magnitude of the extraction current that can be obtained.

An additional problem encountered in high-density, high energy plasma systems is sputtering of the antenna surface. When a bare metal antenna coil is employed in an ion source, problems are often encountered with sputtering of the copper or other metal from the antenna coil, due to ion bombardment of the antenna coil. The sputtered copper or other metal is deposited on other surfaces within the vacuum chamber of the ion source, and may exacerbate other problems, such as current leakage or short circuits between electrodes.

There are several approaches that attempt to solve the problems of voltage breakdown, sparking, arcing, and sputtering by covering the bare copper tube of an antenna coil with an additional layer of dielectric. All of these approaches, however, are limited in their effectiveness by the types and thickness of dielectric that can be coated over a copper tube. For example, sleeving material made of woven glass or quartz fibers can be inserted over a copper tube. However, the woven glass or quartz sleeving provides only limited protection against voltage breakdown, sparking, and arcing. Consequently, the efficiency of antenna coils covered with common sleeving materials is poor at high voltages. Additionally, this approach reduces sputtering but does not eliminate it. The sleeving does not make good thermal contact with the antenna, which results in problems with overheating. Moreover, the woven glass or quartz sheathing introduces the additional problem of causing the evolution of contaminating gases, such as oxygen and water vapor, which are driven out of the woven glass or quartz material during the operation of the ion source, due to the heat generated in the ion source during normal operation.

Another attempted solution is to coat the copper coil of an antenna with a glass-like coating (a glass frit) that is baked onto the surface of a copper tube. This approach was described by one of the present inventors in U.S. Pat. No. 4,725,449, which is incorporated by reference herein. The glass coating permits the coil to be operated at higher voltages than a bare coil or a sheathed coil without sparking or arcing between coil elements. This improves the efficiency of the antenna. Another advantage is that since glass is electrically insulating, the exterior of the antenna floats at a lower negative potential than that applied to the antenna. This reduces the sputtering of antenna material by the surrounding plasma ions. However, there are several limitations to this approach. First, there are practical limitations to the type of glass frit and the thickness of the glass layer that can be applied to the surface of a copper tube. The thickness of the glass coating is typically less than 1 mm (e.g., on the order of 0.1 mm), which limits the ability of the coating to protect the antenna from arcing and sparking at high field strengths. Moreover, at high power levels, high energy electrons appear to penetrate the glass coating and significantly degrade its electrically insulating properties. The thin glass coating is also inherently fragile. Another problem at high power levels is that there may be large thermal stresses resulting from differences in the thermal coefficient of expansion (TCE) of copper and the glass layer. Additionally, even if the TCE is matched, thermal stresses can arise because of thermal gradients (e.g., differences in transient or equilibrium temperature of the copper tube and the glass layer). The thermal gradients causing thermal stresses can be calculated. Those skilled in the art of thermodynamical engineering are familiar with mathematical techniques to calculate the transient and equilibrium temperature rise in a multilayer structure comprised of an outer layer and an inner layer connected to a heat sink. The inner surface of the copper tube is in contact with the coolant. The copper is resistively heated by the RF current. The outer glass coating is heated by the copper and to a lesser extent by the plasma. At high power levels, the glass coating may crack or flake-off from the stresses caused by differences in TCE and the thermal gradients. Practically, the glass coating is not an effective electrical insulator at pulsed RF powers above about 25–30 kW.

Still another attempted solution is the use of a porcelain coating applied to a copper tube antenna. This approach is described by one of the present inventors in U.S. Pat. No. 5,587,226, which is incorporated by reference herein. The porcelain coating permits higher power levels than the use of a glass frit coating. However, at high power levels, the thermal gradients can cause flaking or cracking of the porcelain. Additionally, while in principle a comparatively thick layer of porcelain can be applied, typically less than 1 mm thick layers are utilized. Consequently, the porcelain coating is often too thin to provide the desired dielectric strength at high RF voltages. Finally, another problem with a porcelain coating is that it is unsuitable for some types of applications. For example, in semiconductor processing, the sputtering of the porcelain surface at high power levels may create an undesirable source of contamination. Oxygen plasmas can also attack the porcelain, making the porcelain antenna unsuitable for the generation of a high density oxygen plasma.

The above described attempted solutions rely upon coating a copper tube with a dielectric layer. As described above, the performance of such antennas are limited by the types and thicknesses of dielectric material that can be coated over a copper tube. The dielectric layer may not be as thick as desired at high RF powers, leading to reduced efficiency. Thermal stresses on the dielectric coating and/or attack by the plasma may limit the operating conditions with which the antenna can be used.

A fundamentally different attempted solution to creating a high efficiency RF antenna is to insulate a metallic conductive element inside a hollow glass or quartz tube. This approach is hereinafter referred to as the "glass tube" antenna approach. As shown in the prior art cross-sectional schematic of FIG. 2, in conventional glass tube antennas the coil is comprised of a glass tube 20 containing an inner conductor 18*b*. The glass tube 20 enters the top of the vacuum chamber 14 through wall entrances 22. In the center of the vacuum chamber 14 the glass tube has the shape of coils 18*a*. In conventional glass tube antennas the conductor 18*b* may be formed from either a conducting layer precipitated onto the walls of the tube 20 or it may be a conductive "chord" inserted into the tube. The glass tube antenna approach has the advantage that the glass can be thick enough to protect the conductive elements of the antenna from shorting or arcing at high field strengths. Additionally, high energy electrons are less likely to degrade the dielectric properties of a comparatively thick glass tube. Coolant may also be flowed through the glass tube 20. Unfortunately, conventional glass-tube antennas have several problems that limit their efficiency and make them impractical for use in common plasma systems, particularly at high power levels. Conventional glass-tube antennas are typically not used in high-power density plasma systems even though the potentially thicker dielectric layers may reduce arcing and sparking at high RF powers.

Many factors have prevented the widescale use of glass-tube antenna structures. One problem is that in many applications, such as proton therapy, boron neutron capture therapy (BNCT), neutron radiography, and spallation neutron sources, the antenna must be positioned in the central discharge chamber where the uniform plasma density is produced. Consequently, the reliability of the antenna is a major concern. Another problem the limits the usefulness of conventional glass tube antennas is the thermal problems that hinder achieving a compact, high-power antenna design. For example, in many applications it is desirable to reduce the radius of curvature of the antenna coil and decrease the outer diameter of the tubing used to fabricate the coil. However, a small diameter glass tube will have a relatively high resistance to fluid flow, which may limit the flow of a coolant. Although the coolant pressure can be increased somewhat to increase the fluid flow rate, a small diameter glass tube with comparatively thin walls will burst if the pressure is raised too high. Consequently, the maximum flow rates of coolant must decrease as the tube size decreases. However, as the tube size is decreased, the cross-sectional area of the enclosed conductive element must also decrease. This increases the resistivity of the conductive element, which leads to a greater heat load. A combination of reduced coolant flow rates, a higher heat load, and weaker tube walls all exacerbate the problem of preventing the glass tube from cracking because of thermal stresses. Consequently, a conventional glass tube antenna may be thermally limited to RF powers substantially below what is desirable for a plasma system, particularly if the glass-tube antenna is reduced to a size comparable to those of conventional porcelain coated copper tube antennas.

The inventors' own experiences with the design of antennas for RF plasma systems leads them to believe that those skilled in the art are reluctant to use conventional glass-tube antennas because of the concern that such an antenna may catastrophically fail, exposing the vacuum system to atmospheric gases and coolant. This is true even if the antenna is not driven to its thermal limits. Glass is more fragile than copper. It is inherently more difficult to design a self-supporting glass-tube antenna structure that can support its own weight and survive mechanical vibration and shock without fractures developing in the antenna or at its feedthroughs.

What is desired is a compact, efficient, high-power glass tube antenna and an antenna assembly design that facilitates operating the antenna reliably at high RF powers with a low probability of catastrophic failure.

SUMMARY OF THE INVENTION

The present invention is directed to an antenna suitable for high-power RF applications, generally comprising a conductive element disposed in the interior of a dielectric tube. The conductive element may further comprise a plurality of conductive wires. The diameter and number of wires may be selected to increase the cross-sectional area available for RF conduction of current, thereby reducing the RF resistance of the antenna. The number of wires, diameter of wires, and distribution of wires within the tube may be further selected to reduce thermal stresses in the antenna. Furthermore, the number, diameter, and material composition of the wires may be selected such that the wires perform a fuse-like function to limit further heating in the event of a sudden loss of coolant.

The present invention also comprises an antenna assembly that provides a means to reliably and conveniently use the antenna of the present invention in a vacuum system. The antenna assembly includes a mounting plate with resilient vacuum feedthroughs to cushion the end portions of the antenna. Shield members protect exposed end regions from accidental damage. Additional connectors permit low stress and low torque electrical and coolant connections to be made to the antenna.

BRIEF DESCRIPTION OF THE DRAWINGS

FIG. 1 is a cross-sectional side view of a prior art ion source utilizing an RF antenna to excite a plasma.

FIG. 2 is a cross-sectional side view of a prior art antenna comprised of a conductive chord shielded by a glass tube.

DETAILED DESCRIPTION OF THE INVENTION

Figure 3A:
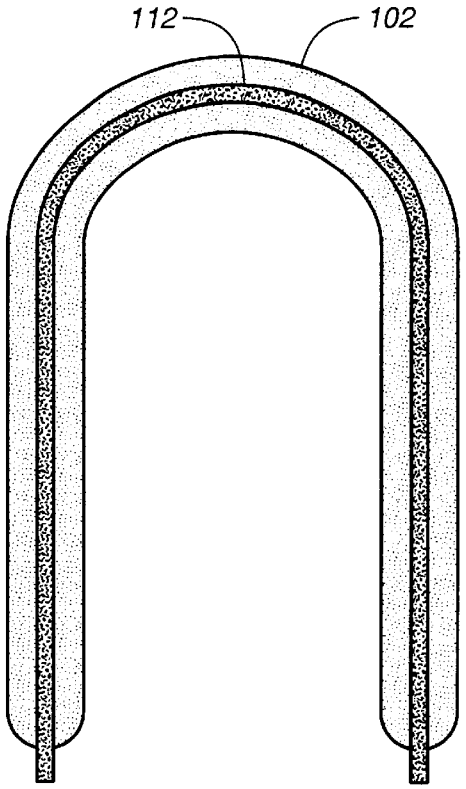
FIG. 3A is a schematic top view of a portion of the antenna of the present invention.

The inventors' studies lead them to conclude that a compact, efficient glass tube antenna cannot be practically fabricated using a conductive element comprised of a single wire or a precipitated coating. First there are fabrication problems associated with the conductive element, particularly as the dimensions of the antenna are reduced. Wire cannot practically be brazed into a glass tube as it is blown. If a conductive wire is used as the conductive element it must be inserted into a glass tube after the glass is blown. However, inserting a large diameter wire into a blown coil presents practical problems. It is difficult to insert a large diameter copper wire (e.g., greater than 1 mm diameter) into a narrow diameter (e.g., less than 4 mm inner diameter) glass tube that has been shaped into compact coils (e.g., radius of curvature less than 5 cm). The stiffness of the wire, the sharp radius of curvature of the coil, and the frictional forces of the wire rubbing against the tube walls make it impractical to insert a large diameter wire into a compact, multi-turn coil.

The inventors also believe that it is impractical to utilize a conductive element comprised of a precipitated conductive coating applied to the inner surface of a blown glass-tube for high-power applications. There are limitations on the types, thicknesses, and uniformity of the conductive coating that can be precipitated onto a glass tube, particularly as the tube diameter and coil dimensions are reduced. Moreover, there may also be reliability problems for high power RF operation. A conductive element comprised of a precipitated conductive coating is resistively heated when the antenna is in operation. The conductive coating is in direct contact with the inner walls of the glass tube, which may create thermal gradients and high stresses. For high power cw operation, stresses may be created by the differences in the thermal coefficient of expansion between the conductive coating and the glass. Additionally, every time the antenna is turned on, the conductive coating may experience a rapid transient temperature rise before thermal equilibrium with the glass is reached. Consequently, the conductive coating may peel or the glass may fracture from the thermal stresses at the conductor/glass interface. All of the above-described problems make it impractical to fabricate a glass-tube antenna that is compact, efficient, and reliable.

The inventors' studies lead them to believe that catastrophic failure of the antenna (particular if the antenna is operated at high RF powers) is another barrier to the wide scale use of glass tube antennas in plasma systems. Compared to copper tubing, glass tubing is fragile and unforgiving to thermal shock. There is thus the potential for the glass tube antenna to crack or break during operation, letting atmospheric gases or coolant flow into the plasma system. This can be defined as a catastrophic failure, since the failure of the antenna may deleteriously affect other components of the vacuum system and damage materials that are being processed by the plasma system. For example, in a plasma system used to process semiconductor wafers, cracking of the glass tube during operation could lead to an inflow of atmospheric gases, coolant, and debris from the antenna that could result in damaged wafers; burned out filaments (e.g., hot filaments, such as that used to initiate a plasma reaction will burn up upon sudden exposure to oxygen or water); contaminated vacuum pumps (e.g., many vacuum pumps may become overloaded by sudden exposure to atmosphere and water such that they must be regenerated); contaminated chamber walls (e.g., coolant sprayed onto chamber walls and/or contaminants backstreamed from overloaded vacuum pumps); and abrasive dust (e.g., shattered antenna glass) entering valves and seals.

There are several different physical mechanisms that may cause catastrophic failure of a glass tube antenna. One failure mechanism is the large thermal gradients that may occur during cw operation. Glass tube antennas may crack inside of a plasma system because of the large thermal gradients caused by the resistive heating of the conductive elements inside of the tube during antenna operation. If the heat dissipation rate is excessively large compared to the coolant flow rate, the coolant (e.g., water) may even boil. This is particularly true if the RF resistivity of the antenna is high, the RF currents are large, and the coolant flow rates are low. Boiling of the coolant is undesirable because it may cause non-uniform cooling along the coil and because it will increase the pressure on the glass tubing.

Heat loads in a glass tube antenna may be significantly worse compared with conventional porcelain antennas, exacerbating the problem of large thermal stresses acting to crack the glass. Typically, the resistive heating of a glass tube antenna will be higher than for conventional copper tube antennas of comparable outer diameter. Conventional copper coil antennas use copper tubing with an outer diameter typically greater than 5 mm. A glass tube antenna with the same outer diameter would have a smaller inner diameter (e.g., 3 mm), which limits the potential size of the enclosed conductor. Additionally, the potential conductor size is further limited if space is reserved for the flow of a coolant. Moreover, at high RF frequencies, the effective cross-sectional area for electrical current flow may be still further reduced. Classical electromagnetic theory teaches that at high frequency the current distribution in a wire decreases exponentially with a characteristic length $\delta$, or skin depth, from the surface. The skin depth varies inversely as the square root of the frequency and the conductivity of a metal. For example, at a frequency of 1 MHz, the skin depth of copper decreases to 66 $\mu$m.

The heat load problem associated with a glass tube antenna can be illustrated with an example. A copper tube antenna with a mean diameter (average of outer and inner wall diameters) of 5 mm will have an inner and outer surface of the tube available for conduction such that the cross-sectional area available for conduction is approximately $2\times5$ mm$\times\pi\delta$, or $10\,\pi\delta$. By way of comparison, a 1 mm diameter wire in a 5 mm outer diameter (3 mm inner diameter) glass tube (assuming that the wire could be inserted) has a cross sectional area available for conduction of $\pi\delta$. Since the RF resistance is inversely proportional to the cross-sectional area available for conduction, the RF resistive heat load of this glass-tube antenna would be ten times higher for a given RF power than a copper tube antenna with a comparable outer diameter.

Another failure mechanism for a glass tube antenna is the formation of cracks or fractures at the vacuum feedthrough sites through which electrical and coolant connections are made to the interior of the antenna. Conventional vacuum feedthroughs, such as those found in high power vacuum tube structures used in physics and chemistry experiments, typically consist of a glass or ceramic plate fused around a glass tube to form a vacuum seal around an electrical connector to which external electrical connections can be made. Conventional feedthroughs for glass tube antennas typically have two end portions of the glass tubing extending out from the feedthrough a short distance in order that electrical and fluid connections may be conveniently made. The antenna (and also the feedthrough itself) may crack because of the forces coupled to the feedthroughs by the extended sections of the glass tube. This is because extended portions act like lever arms for both static torques and impulses. Any mechanical loads attached to the extended portion of the glass tubing may create a torque at the feedthrough acting to snap the brittle feedthrough. Additionally, impulses, such as that created by accidentally striking the glass tube during equipment maintenance, may create a shock wave that shatters the feedthrough.

Still another failure mechanism associated with conventional glass-tube antenna constructions is that the antenna may catastrophically fail if the coolant supply is interrupted during cw operation. At high operating powers, the antenna will require continuous cooling for cw operation. Compared to copper tube antenna constructions, glass-tube antennas are very unforgiving to interruptions in coolant supply. Even a brief interruption or decrease in coolant flow rates to a glass-tube antenna could lead to large thermal gradients which may crack the glass. For example, in the event of a sudden coolant decrease or failure, the conductive element will rapidly increase in temperature because of resistive heating. Those portions of the conductive chord that are in contact with the glass will rapidly heat the glass, causing large thermal stresses. Rapid boiling of residual coolant may also occur, increasing the pressure on the glass.

All of the above described failure mechanisms are exacerbated when a glass tube antenna is reduced in size. Extremely compact glass tube antennas require glass tubes with a comparatively small outer diameter. The inner diameter of the glass tube will also be similarly reduced in size. Consequently, the RF conductor in the glass tube will be small and the rate at which at coolant fluid can be pumped through the glass tube will also be limited. Heating problems will thus tend to become more severe for a compact glass tube antenna. Catastrophic failure is more likely in a compact glass tube antenna because the heating problems are more severe, coolant flow rates are smaller, and because the walls of the glass tube may also be thinner.

However, there are several applications where it is desirable to reduce the size of the antenna. In many plasma applications it is desirable to limit the vacuum and power supply requirements by reducing the volume of excited plasma. Also, small neutron tubes require small ion sources and hence compact antennas. Conventional glass tube antennas are not suitable for such applications.

All of the above-described failure mechanisms prevent the wide-scale use of glass tube antennas in plasma systems, particularly in applications such as small neutron tubes where a compact antenna is required. However, glass tube antennas have the desirable benefit of a thick dielectric layer to prevent shorting and arcing at high field strengths. Additionally, glass tube antennas are in principle highly compatible with silicon wafer processes. The glass tube can be comprised of a comparatively "clean" form of silicon dioxide such that material sputtered from the tube will not deleteriously contaminate a silicon wafer processed using the plasma or ions generated by the glass tube antenna. Silicon dioxide based glasses are also resistant to oxygen plasmas, which are of interest in some applications. Unfortunately, no presently known, conventional glass tube antenna is efficient, compact, resilient to mechanical vibration and thermal stresses, and resistant to catastrophic failure in the event that the supply of coolant is cut off during cw operating conditions. Additionally, no conventional antenna assembly cushions the glass tube from shock and vibration, permits electrical and coolant connections to be conveniently made to a glass-tube antenna, and guards the feedthroughs from the effects of vibration, torque, and impulses that could cause the antenna to shatter at the feedthroughs.

The inventors' research leads them to believe that an antenna comprised of a conductor in a dielectric tube is impractical for use in a vacuum system unless the antenna is designed to address the mechanical stresses which may cause the antenna to catastrophically fail. Consequently, the present invention is generally directed to an antenna design, antenna assembly, and connector apparatus that permits the reliable, high-power operation of an antenna comprised of conductive elements within a dielectric tube.

Figure 3B:
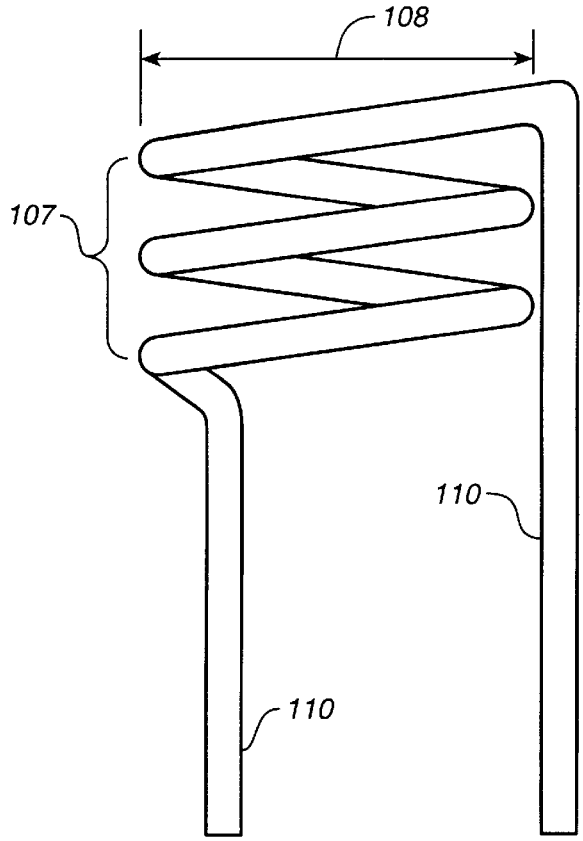
FIG. 3B is a schematic side view of an antenna coil of the antenna of the present invention.

FIG. 3A is a top view of a portion of an antenna coil of the present invention, not necessarily drawn to scale. The antenna of the present invention comprises an insulating dielectric tube 102 and a conducting element 112 disposed within the glass tube. The dielectric tube may be comprised of glass, quartz, or other suitable dielectric materials that have a comparatively high resistance to dielectric breakdown at high RF field strengths. As shown in the side-view of FIG. 3B, the glass tube is blown into a generally coil-like or serpentine shape having a series of coil loops 107, although those skilled in the art are familiar with the variety of antenna shapes consistent with a particular plasma or ion source application. The coil loops 107 will have an associated coil diameter 108. Additionally, the blown tube 102 has substantially straight and parallel end regions 110, that as described below, typically extend outside of a vacuum system.

Figure 3C:
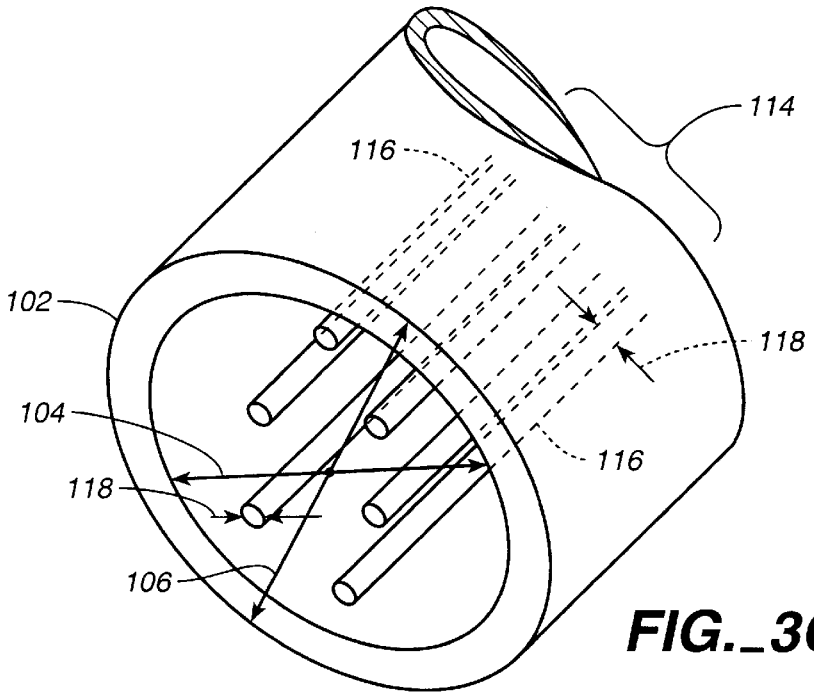
FIG. 3C is schematic cross-section through a dielectric tube of the present invention.

As shown in the perspective view of FIG. 3C, the conductive element 112 of the present invention may be comprised of a wire strand 114 consisting of a plurality of small diameter wires 116, each having a wire diameter 118. The dielectric tube 102 has an associated inner diameter 104 and outer diameter 106. Preferably, each individual wire 116 is flexible enough to be easily threaded through coil loops 107 while the number of individual wires is sufficiently large to achieve a reasonable RF resistance. The inventors have utilized commercially available strands of nineteen silver-plated copper wires each approximately 0.0075" to 0.009" in diameter. The individual wires are flexible enough to conform to even an extremely small radius of curvature. However, commercially available strands are typically coated with an additional coating of electrical insulation covering the entire strand. This electrical insulation also serves as a thermal insulator. It also obstructs the flow of fluid through tube 102. Preferably, the insulation is removed from wires 116 in order that the coolant can efficiently cool wires 116.

The inventors have developed a technique to thread an un-insulated strand into a narrow diameter glass tube. Insulated strands of wires cannot be easily inserted into narrow diameter glass tubes (e.g., less than 4 mm inner diameter) because an insulated strand is typically stiff and has a relatively high coefficient of friction with the walls of a small diameter tube. Un-insulated strands typically become tangled in a narrow diameter tube. The first step requires cutting a length of insulated wire greater than twice the path length of the antenna coil. The second step is to thread approximately half of the strand through the coil. Alcohol may be used as a lubricant to facilitate threading the insulated strand through the glass. Alcohol is a preferred lubricant because it dries without leaving a residue that is deleterious to glass. Approximately half of the insulated strand is pushed through one end of the tubing until a small portion of the insulated strand extends from the other end. Additionally, the strand may be pulled into the coil by using a small diameter wire previously threaded through the coil. The third step is to strip the insulation from the portion of the strand left outside of the coil. This results in an insulated strand in the coil connected to an un-insulated strand slightly greater in length than the coil path length extending out from the coil. The fourth step is to pull the insulated portion of the strand through the coil, which draws the un-insulated segment through the coil. The insulated portion of the strand can then be cut away. This leaves a loosely packed strand of un-insulated wires 116 disposed in tube 102.

Preferably, the number of wires, wire dimensions, and wire composition of strand 114 are consistent with an RF resistance comparable to those of other high-power RF antennas used in ion sources and plasma systems, such as porcelain coated copper tube antennas. However, conventional copper wires form a comparatively high resistance surface oxide, particularly with prolonged exposure to water and other common coolants. Preferably, the wires are coated with a corrosion resistant layer such that the surface conductivity of the filaments is not substantially decreased by oxidation or corrosion of the filaments in atmosphere or in common coolants. The corrosion resistant layer is preferably a chemically inert metal film that does not corrode in atmospheric gases or common coolants. Suitable corrosion resistant layers include a thin layer of silver or gold. Additionally, the entire wire could comprise a corrosion resistant metal (e.g., a thin gold wire).

A variety of coolants may be used for cw operation of the antenna. Recirculating solutions of water with other chemicals (e.g., antifreeze-like mixtures) could be used as the coolant. Also, various gases, such as nitrogen, helium, or pressurized air could be used. However, water is a preferred coolant because a low pressure (e.g., 1–20 p.s.i.) coolant source may be inexpensively obtained from ordinary plumbing line fixtures.

It is desirable for high power cw operation that the antenna not overheat. Maintaining a reasonable operating temperature of the antenna requires balancing heat generation rates with practical cooling rates consistent with a flow of coolant through tube 102. The heat generation rate will decrease if the RF resistance of the antenna if reduced, such as by using a larger number of wires 116. However, the potential coolant flow rates will depend, to first order, on the maximum pressure that the glass tube can safely withstand and upon the cross-sectional area in tube 102 available for fluid flow. Preferably, the plurality of wires 116 should have a RF resistance that is less than that of a conventional antennas (e.g., porcelain antennas and conventional glass tube antennas) of approximately the same size. Preferably, the plurality of wires 116 should not reduce the potential flow of coolant so severely that a glass tube antenna cannot be effectively cooled during high power cw operation.

Selection of the number of wires 116 and wire diameter 118 requires a tradeoff between the RF resistance of the wires and the cross-sectional area available for the flow of a coolant. Increasing the number of wires reduces the RF resistance of the antenna but will also reduce the cross-sectional area available in tube 102 for coolant flow. Preferably, the surface-to-volume ratio of the individual wires 116 is high such that wires 116 have a large surface area for RF conduction while minimally obstructing the flow of a coolant through tube 102. Preferably, the individual wires 116 have a diameter 118 less than about twenty times the electromagnetic skin depth at the desired RF frequency such that the ratio of the cross-sectional area available for RF conduction compared to the cross-sectional area of the wire 116 obstructing coolant flow is high. The conductive cross-sectional area of a wire of outer radius, r, conducting in a thin outer annulus corresponding to the RF skin depth, $\delta$, is $\pi(r^2-(r^{-\delta})^2)=2\pi r\delta-\pi\delta^2$. Dividing this expression by the copper area, $\pi r^2$, gives the ratio of cross-sectional area available for RF conduction compared with the actual copper area, which is $2\delta/r-\delta^2/r^2$. This ratio rapidly increases when the radius of the wire is reduced in magnitude to approximately ten times the skin depth. In one embodiment of the present invention, nineteen wires 116, each having an outer diameter of 0.0075" (190 microns) are utilized in a glass tube with an inner diameter of 2 mm. At a frequency of 1 MHz the radius of the wire (96 microns) is approximately one and a half times the skin depth (66 microns) such that a large fraction of the copper acts as an RF conductor.

Appropriate selection of the diameter 118 of each wire 116 and the total number of wires in the strand 114 permits a low RF resistance to be achieved while also leaving a substantial cross-sectional area of tube 102 open for the flow of coolant. For example, the above-described 19 filamentary conductors consume approximately 17% of the cross-sectional area of a tube with a 2 mm inner diameter. This leaves 83% of the tube available for the flow of a coolant, be it a flow of gas (for pulsed operation) or water coolant (for cw operation). The 19 filamentary conductors will have a total cross-section conducting area for RF current of approximately 0.46842 square millimeters. By way of comparison, a solid copper wire (assuming that it could be threaded into the antenna) that permitted the same cross-sectional area for coolant flow would have a radius of 0.415 mm. However, such a solid conductor would have an effective RF cross-sectional conductive area of about 0.172 square millimeters, corresponding to approximately a factor of 3 times higher RF resistivity compared to the strand. The RF conducting area of the previously described plurality of conducting wires, is in fact, potentially larger than if the tube was entirely filled with a solid copper wire 2 mm in diameter (which would have an effective RF cross sectional area of about 0.414 $mm^2$).

The present invention thus permits a low RF resistance and a large cross-sectional area for coolant flow. This permits a glass tube antenna of the present invention to have highly favorable thermal properties and facilitates high power cw operation of the antenna. Those skilled in the art could perform a rigorous computer analysis of the thermal properties of a particular antenna design at all power levels. However, one way to understand the potential performance advantages of the present invention is with reference to the maximum thermal load with which the coolant can maintain the antenna within a safe operating temperature at a thermally limited maximum RF current. The RF resistive heating at the maximum RF power by the equation $I_m^2R_{eq}$, where $I_m$ is the thermally limited maximum RF current and $R_{eq}$ is the equivalent RF electrical resistance of the antenna.

The maximum rate at which the coolant can extract heat will depend upon the maximum acceptable temperature rise of the coolant and the maximum flow rate of coolant. The maximum temperature rise of the coolant (e.g., difference in coolant temperature between the inlet and outlet of tube 102) is limited (e.g., the outlet temperature of the coolant should be less than the boiling point temperature of the coolant). The maximum coolant flow rates will depend upon the maximum safe pressure and will decrease if the cross-sectional area of the tube is obstructed by wires. Consequently, the maximum cooling rate, $W_m$, will depend (in a first order approximation) on the cross-sectional area available for coolant flow when the antenna is operated at the maximum safe coolant pressure and with the largest acceptable increase in coolant temperature. This can be expressed by the equation $W_m=kA_cP_m$, where k is a constant, $A_c$ is the cross sectional area available for the flow of a coolant, and $P_m$ is the maximum safe coolant pressure.

At the thermal limit, the heat load generated by the resistance of the antenna will be balanced by heat extracted by the coolant. At the maximum RF power, heat generation is balanced by cooling such that $I_m^2R_{eq}=kA_cP_m$. This expression can be normalized such the present invention can be compared with conventional antenna structures of comparable dimensions. If $A_m$ is the maximum tube area available without any wires and $R_s$ is the RF surface resistance that would result if the interior wall of the tube was coated with a copper conductor (e.g., if a copper tube or glass tube with a precipitated metal coating was used), then the above heat balance can be expressed as $R_{eq}A_m/A_cR_s=A_mkP_m/R_s/I_m^2$. This expression indicates that the maximum thermally limited RF current may be increased above what can be achieved with conventional porcelain antennas (or conventional glass tube antennas with a precipitated metal film on the interior of the tube walls) if $(R_{eq}/R_s)(A_m/A_c)<1$. The use of a plurality of wires may yield a substantial improvement in heat loads over a glass tube antenna with a precipitated coating or a porcelain antenna if $(R_{eq}/R_s)(A_m/A_c)<1$. It is thus desirable in the present invention that $(R_{eq}/R_s)(A_m/A_c)<1$ such that the maximum cw RF power has a higher thermal limit than conventional porcelain antennas or conventional glass tube antennas. Since RF currents primarily flow within a skin depth of the surface, this can be achieved by increasing the surface area of wires 116 such that they have a total combined surface area significantly greater than the surface area of the interior of tube 102.

Figure 4A:
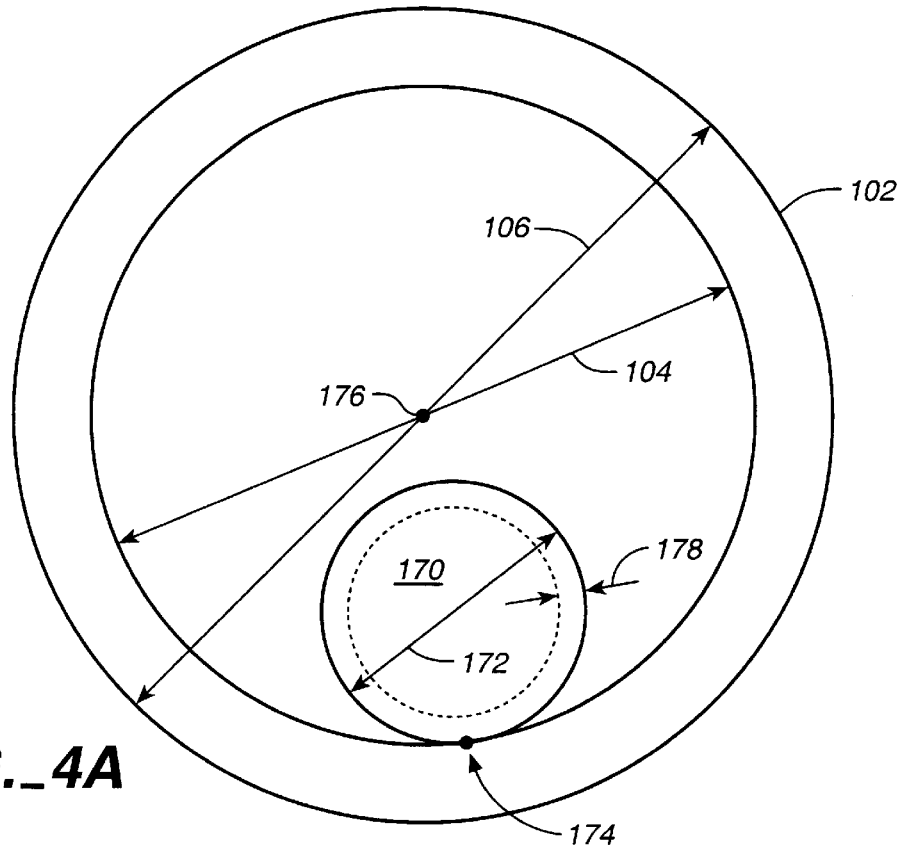
FIG. 4A is schematic cross-section through a dielectric tube enclosing a single large diameter wire.

The inventors have also realized that thermal gradients may be reduced in the present invention because of the distributed nature of the conductive wires 116. As is well known in the field of thermodynamics, a heat load generated from a compact source will tend to produce larger thermal gradients than an equivalent heat load generated from a substantially larger source. Large thermal gradients can exist in a compact resistive element even though the heat load generated from resistive heating is balanced by heat extracted by the flow of a coolant. As shown in FIG. 4A, a large diameter solid wire 170 with a diameter 172 that is disposed in a tube 102 would be expected to contact the glass at numerous points 174 inside the coiled glass tube. Little or no coolant flows along the surface of the wire proximate to its contact point 174. The average wire temperature may be substantially higher than the temperature of the coolant in the center 176 of tube 102. Also, the heating occurs in a small RF skin depth 178 such that the temperature of large diameter wire 170 may be significantly higher at contact point 174 than the average wire temperature. The local thermal gradients on the tube walls may be excessively large, even if the coolant flow rates through the tube are high enough to balance the total heat load generated by resistive heating.

Figure 4B:
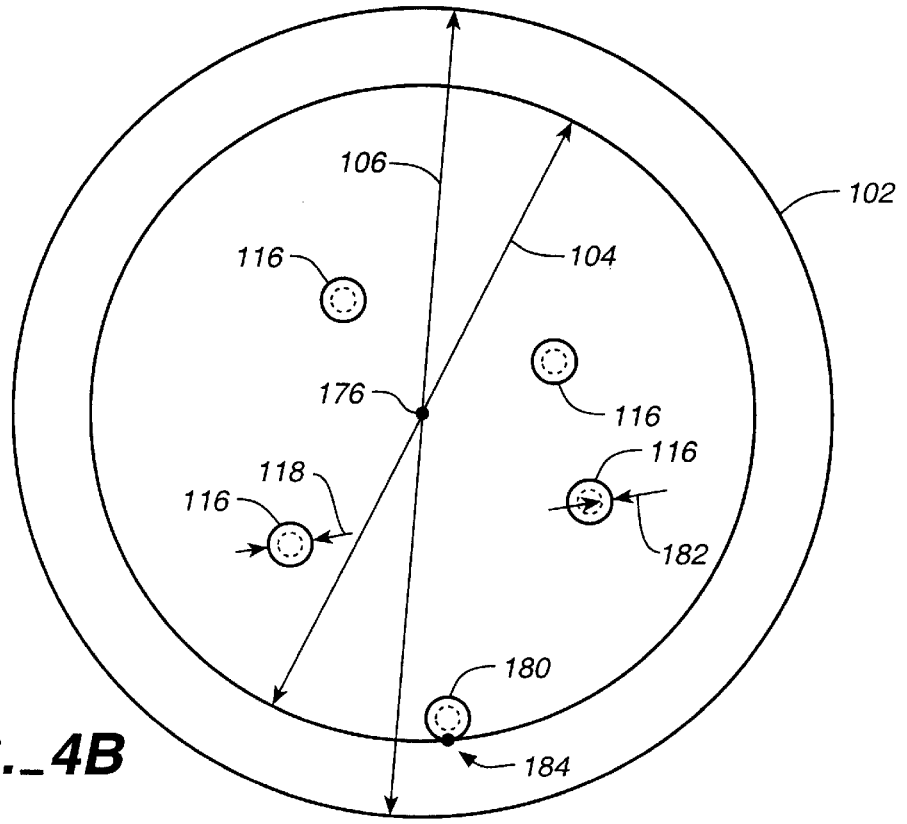
FIG. 4B is schematic cross-section through a dielectric tube of the present invention in which a plurality of small diameter wires are enclosed.

Referring to FIG. 4B, the thermal gradients in the antenna of the present invention may be substantially reduced. The strand 114 will tend to expand in tube 102 such that wires 116 loosely fill tube 102. The spacing between wires 116 defines gaps or channels for the flow of a coolant. As shown in FIG. 3C, the wires 116 are preferably generally uniformly distributed throughout the cross-sectional area of the tube to further reduce thermal gradients in the antenna and to permit more efficient cooling of the antenna. Preferably a substantial cross-sectional area is available for the flow of a coolant around wires 116. A strand 114 comprised of a plurality of wires 116 is a distributed heat source in which the sources of heat comprise a plurality of resistive wires distributed throughout the tube. The heat generation rate in an individual wire 116 may be significantly smaller than for the case of a single large diameter wire. Consider a strand 114 containing a total number of wires, n, where the strand has the same equivalent RF resistance as a large diameter wire 170. Each of the n-wires 116 in strand 114 will generate a fraction, 1/n, of the heat of a large diameter wire 170 having the same equivalent resistance as the combined strand. Consequently, it is likely that thermal gradients will be reduced because of the distributed nature of the heat load.

The large surface-to-volume ratio of small diameter wires 116 may further reduce thermal gradients. Referring again to FIG. 4B, if an individual wire 180 touches the inner surface of tube 102 the thermal gradients and thermal stresses on tube 102 will still be low. Additionally, the surface-to-volume ratio of an individual wire 116 is also high because of the small wire diameter 118. The RF currents will also tend to be limited to an RF skin depth 182 from the surface of the wire 116. However, the large surface to volume ratio of wire 180 will tend to limit temperature gradients inside wire 116 such that wire 180 will tend to remain at substantially the same temperature as the coolant at the center 176 of tube 102. Consequently, the thermal gradients associated with a small diameter wire 180 contacting the tube 102 at a contact point 184 will be low compared to the case of a large diameter wire.

The inventors have experimentally tested several different antenna structures. However, as is well known in the art of antenna design for plasma systems, the preferred dimensions of an RF antenna for a particular application will depend upon many parameters. The size and shape of an RF antenna is commonly adjusted, as needed, for particular applications. Thus, while particular examples are discussed, the present invention permits a high efficiency antenna to be fabricated with a wide range of coil shapes, dimensions, and number of coil turns.

Extremely compact antennas may be fabricated according to the teachings of the present invention. Those skilled in the art of glass blowing are familiar with techniques to blow small diameter glass tubes into extremely compact but low-stress coils. The inventors have fabricated glass-tube antennas that are substantially smaller than what can practically be achieved in prior art porcelain antennas using commercially available sources of copper tubing (e.g., approximately 5 mm outer diameter copper tubing).

Figure 5:
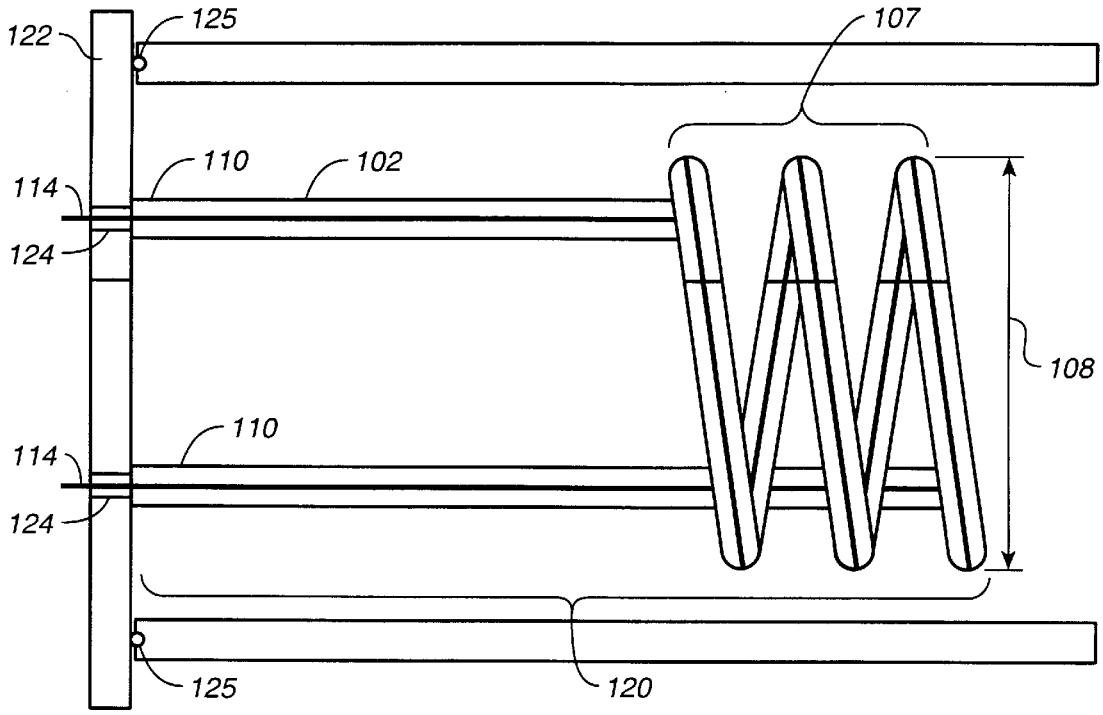
FIG. 5 is a schematic cross-sectional side view showing one embodiment of an antenna coil of the present invention.

An extremely compact antenna constructed according to the teachings of the present invention is shown in FIG. 5. The antenna comprises coil loops 107 consisting of two and a half winding turns. The coil loop diameter 108 is one and a half centimeters. The antenna was fabricated from a glass tube 102 with an outer diameter 106 of 3 mm and an inner diameter 104 of 2 mm. The wire strand 114 used for this antenna comprised of 19 stranded silver plated copper wires 116, each wire having a diameter 118 of 0.0075". The two ends regions 110 of the tube are separated by approximately 1". This particular antenna is extremely compact. Additionally, since this antenna structure is well-suited for pulsed applications, it is typically unnecessary to flow an additional coolant liquid through the tube 102 for such applications.

As shown in FIG. 5, a comparatively simple mounting system may be utilized for this antenna because of its small size and weight. Moreover, since the antenna is primarily intended for use in pulsed-mode applications, additional coolant is unnecessary. The compact antenna 120 may be attached to a disk-shaped quartz plate 122 (1.5" diameter) with two holes 124 to let the threaded strands 114 through. A variety of means may be used to support the compact antenna 120 onto the quartz plate 122. For example, the compact antenna 120 may be attached by fusing the end regions 110 of tube 102 and quartz plate 122 together before strand 114 is inserted into tube 102. Alternately, other support means, such as support struts or connectors may be attached to the quartz plate 122 to facilitate the mechanical attachment and support of the antenna 120. The strand 114 may be connected to an rf-power output directly. The holes 124 through which strand 114 passes through quartz plate 122 may be sealed using a variety of techniques known to those skilled in the art, such as fusing the holes with molten glass or by sealing the holes with epoxy. The quartz plate 122 may have O-rings 125 or other means to permit the entire antenna assembly to be directly mounted onto a vacuum system.

Antennas designed for high power cw operation require that coolant flow through the tube. The weight of the antenna is increased because of the coolant. Consequently, the antenna assembly should preferably provide a low-stress means to support the antenna. This is particularly true for larger antennas. For this case, tube end regions 110 preferably extend outside of the vacuum system in order that convenient electrical and coolant connections can be made to the antenna.

Larger coil antennas suitable for high power operation are also consistent with the teachings of the present invention. The inventors have fabricated an antenna 120 comprises of 2.4 loops 107 having a diameter 108 of 6 cm. The glass tube 102 had an outer diameter 106 of 5 mm and an inner diameter 104 of 3 mm. Wire strand 114 comprised nineteen stranded silver plated copper wires 116 having a diameter 118 of 0.009".

Figure 6:
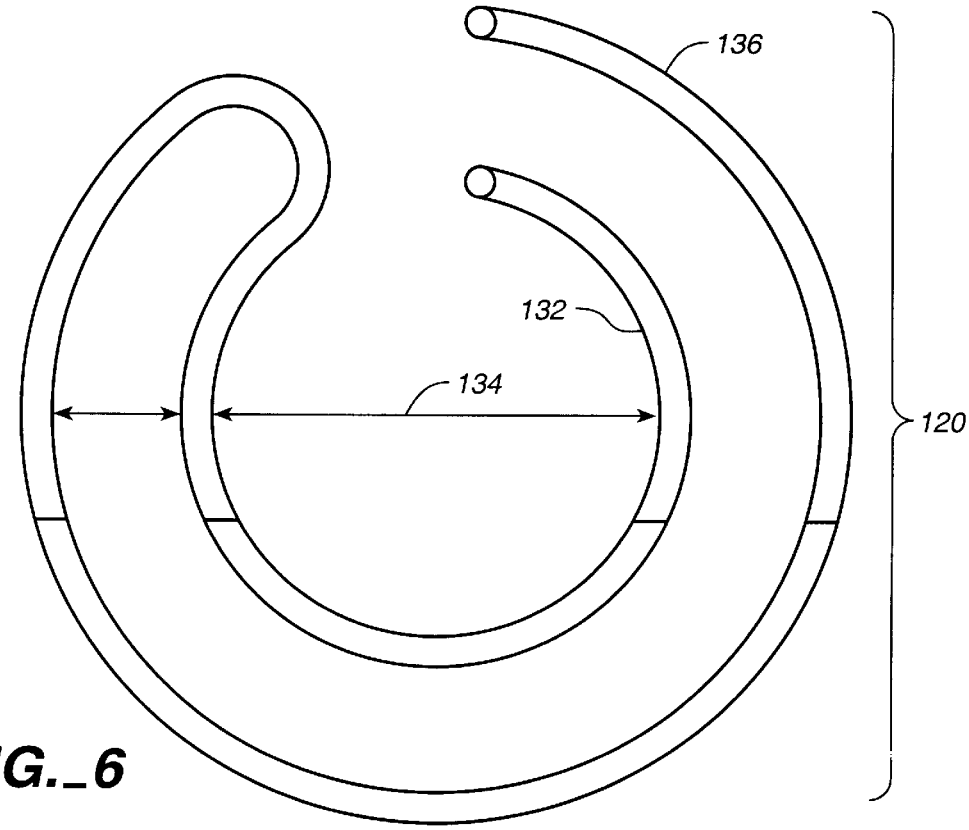
FIG. 6 is a top view of an embodiment of the present invention comprising a planar antenna structure.

Planar single loop antennas have also been fabricated. As shown in FIG. 6, in one embodiment the antenna 120 is planar but shaped to have a first loop region 132 with an inner diameter 134 of 5" and a second loop region 136 separated by 1.2" from the first loop region 132 to form a coil with two effective loops. The glass tube 102 has an outer diameter 106 of 5 mm and an inner diameter 104 of 3 mm. The wire strand 114 comprises nineteen stranded silver plated copper wires 116 having a diameter 118 of 0.009".

Figure 7:
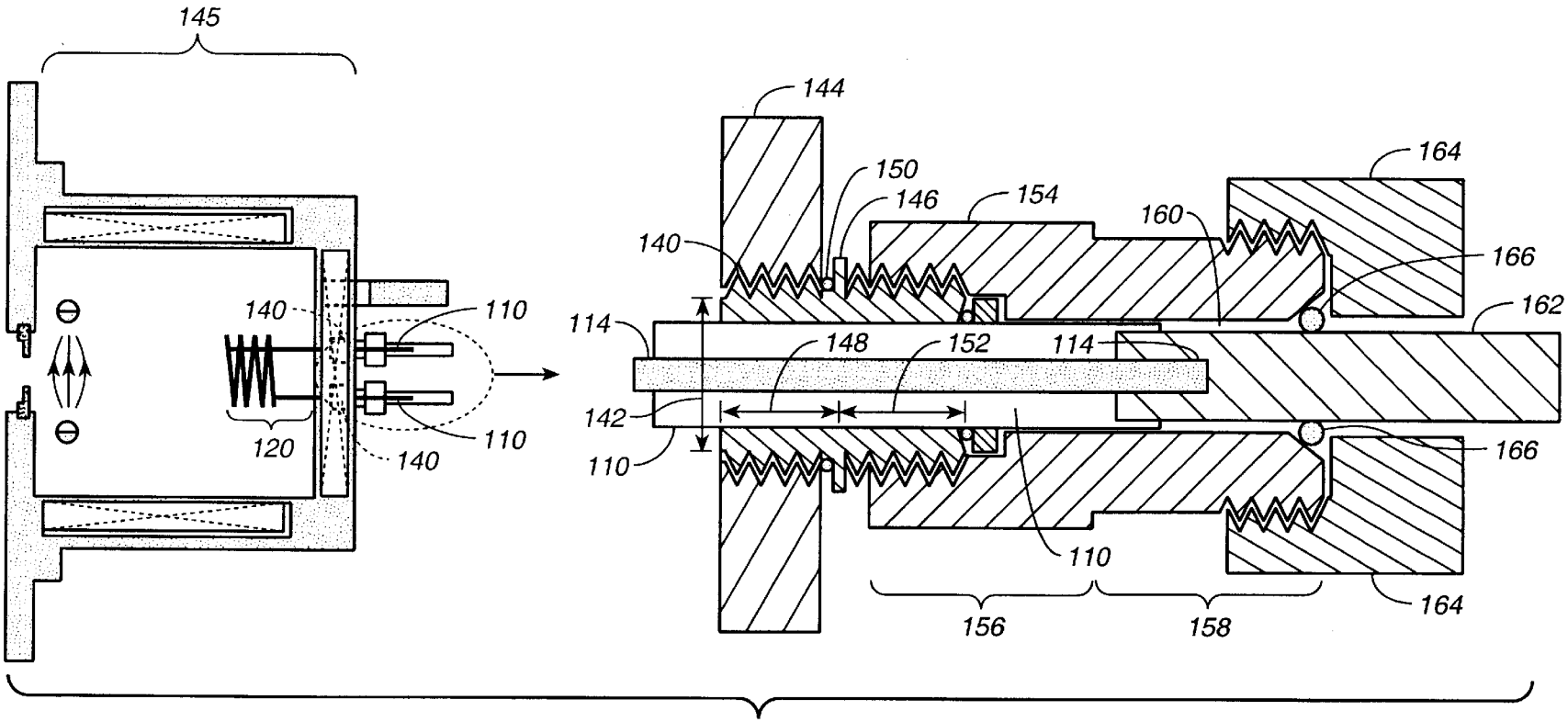
FIG. 7 is a schematic side view of a mounting assembly of the present invention.

As shown in FIG. 7, the present invention also includes a mounting assembly and connector means that addresses the problems of cw operation. End sections 110 of the antenna extend through the feedthrough connectors 140 disposed in holes 142 in the mounting plate 144. The mounting plate 144 may consist of a quartz plate with additional "O"-ring seals such that the plate can be mounted to a plasma system 145.

Preferably, the material composition and structure of the feedthrough connector 140 is selected such that feedthrough connector 140 dampens mechanical vibrations and shock on tube 102. In the present invention, the material used for the feedthrough fitting 140 is a resilient material, such as the plastic known as DELRIN, which is available from several distributors. TORLON, which is manufactured by Amoco Performance Materials, is typically more expensive but is believed to be superior in terms of absorbing shock and vibration. The holes 142 are threaded. The feedthrough connector 140 is 2.5" long with an outer diameter of 0.75" and an inner diameter of 0.2" (approximately 5 mm, to permit a snug fit with a glass tube that is 5 mm in diameter).

The feed through connector 140 has a sealing stop 146 that divides the connector into two distinct regions. The first region 148 of feedthrough connector 140 fits into the hole 142. An additional O-ring 150 provides a vacuum seal against the sealing stop 146. The second region 152 of feedthrough connector 140 extends out from the mounting plate 144 disposed around an end region 110 of the tube 102.

The second region 152 of feedthrough connector 140 is also threaded around its outer surface. An additional threaded shield 154 is screwed over the exposed threads of the second region 152. The shield 154 is a generally annular-shaped member whose inner radius is larger than the outer radius of glass tube 102 such that shield 154 is disposed around glass tube 102 but without applying substantial stress or torque to glass tube 102. The shield 154 may also be attached to second region 152 of feedthrough connector 140 by other means known to those skilled in the art. The shield 154 protects end regions 110 of tube 102 extending past the second region 152 of feedthrough connector 140. The shield 154 may be composed of a rigid metal such as copper, although it may be comprised of other material structures with sufficient rigidity or shock-absorbing capability to protect end regions 110 of glass tube 102 from external forces (e.g., accidentally being struck by a tool during maintenance).

The shield 154 is further divided into a base region 156 and an end section 158. The base region 156 of shield 154 is dimensioned to mate around second region 152 of feedthrough connector 140. The end section 158 of shield 154 has a 0.2" inner diameter channel 160. A copper tube 162 with an outer diameter of approximately 0.2" is soldered to the strand 114 in channel 160 to provide an electrical contact to wires 116 of strand 114. The inventors have determined that leaving an approximately 1 cm portion of uninsulated wire 116 extending out from the end regions 110 of tube 102 is sufficient to provide a long enough portion to be soldered to the copper tube 162. If necessary, end regions 110 of glass tube 102 may also be cut to expose additional wire or to obtain a desirable fit in channel 160. The copper tube 162 may also supply coolant to tube 102. An additional coolant supply connector 164 is attached to end section 158 of shield 154. Additional O-rings 166 provide a water-tight seal between the copper tube 162, the shield 152, and coolant supply connector 164. The materials used in the coolant supply connector 164 may be plastics, metals, or other materials consistent with supporting the copper tube in alignment with the shield 154.

O-rings are well-known as being reliable vacuum seals over a wide range of temperatures for which the O-ring is resilient and thermally stable. Although the sudden complete failure of O-rings is highly unlikely during normal operating conditions, it is well known in the art that small leaks may develop in O-rings used as vacuum seals during extended use. If vacuum O-ring seal 150 leaks, coolant from channel 160 could enter the vacuum system. Preferably, water bleeds (not shown) are added to the shield to help prevent substantial quantities of water entering the vacuum system in case a small O-ring leak develops during operation. These water bleeds may comprise holes in the bottom of the shield prior to the vacuum O-ring seal.

The connection system is an important part of the present invention for operating the antenna at high cw power with a low probability of catastrophic failure. The plastic feedthroughs 140 are resilient, reducing vibration and shock on tube 102. The shield 154 helps to protect the end regions 110 of tube 102 from accidental damage. The shield 154 also provides an alignment and support function for copper tube 162 and coolant supply connector 164, reducing the torque on tube 102 at feedthroughs 140. This is important because the weight of a conventional coolant tube (e.g., a fluid-filled rubber hose) could also apply a torque to end regions 110 of the tube 102. However, in the present invention copper tube 162 is supported by shield 154 via connector 164 such that it does not substantially torque end regions 110 of tube 102. The connectors of the present invention permit electrical and coolant connections to be made quickly, conveniently, and with minimal stress and torque on tube 102 or feedthroughs 140.

Figure 8:
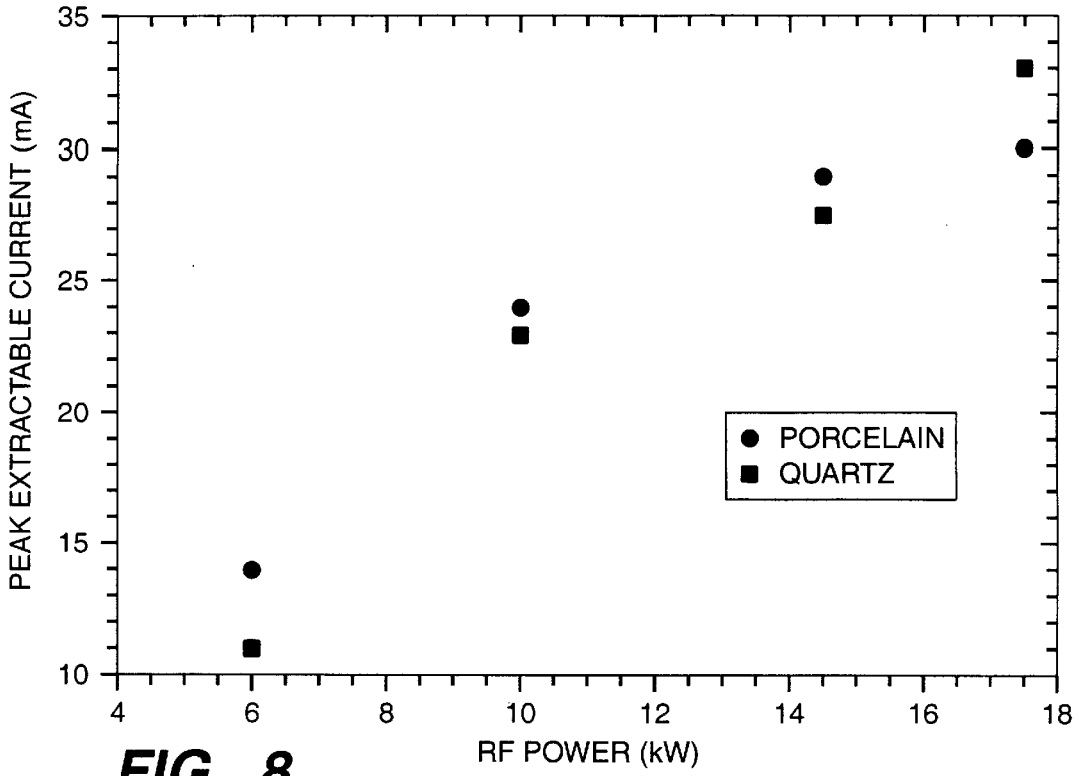
FIG. 8 is graph of peak pulsed extracted current vs. RF antenna power for the antenna of the present invention compared with a prior art porcelain antenna of comparable size.

The antenna of the present invention is capable of extremely high power RF operation. Testing has showed that the glass antenna is more efficient than a conventional porcelain coated antenna at high RF powers. FIG. 8 shows the extracted current versus RF power for the glass tube antenna of the present invention as well as a conventional porcelain antenna under the same pulsed mode operation conditions. Both antennas are of approximately the same coil size and comprise approximately 2.4 coil loops with a diameter of about 6 cm. The thickness of the porcelain coating the porcelain antenna was not measured, but was substantially less than about 1 mm (e.g., on the order of 0.1 mm). The injected gas is hydrogen at a pressure of 5 millitorr in a system with a base vacuum pressure of $1\times10^{-6}$ Torr. The extracted current for the conventional porcelain antenna saturates at around 30 mA at a RF power of 18 kW. However, the glass tube antenna of the present invention does not saturate at pulsed RF powers of 18 kW.

Figure 9:
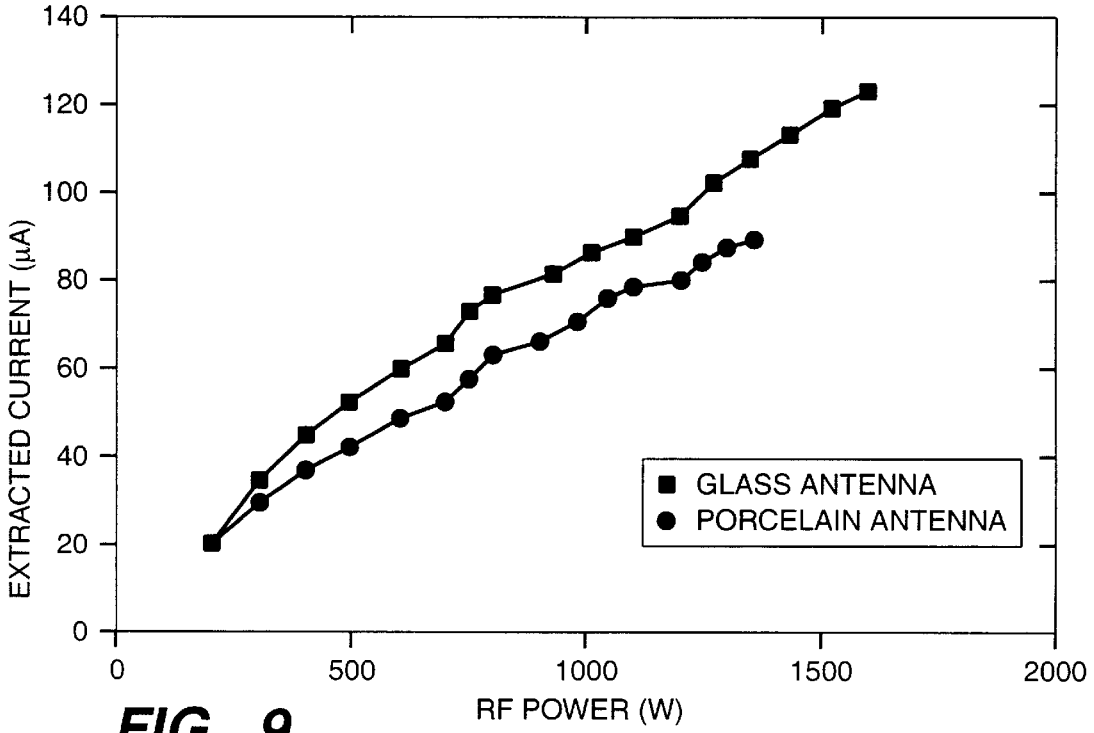
FIG. 9 is a graph of cw extracted current vs. RF antenna power for the antenna of the present invention compared with a prior art porcelain antenna of comparable size.

FIG. 9 shows the extracted current versus cw power for both a glass tube antenna and a conventional porcelain antenna operated under similar gas conditions as those of FIG. 8. The antenna dimensions are the same as those described above. As shown in FIG. 8, the glass tube antenna achieves a significantly larger extracted current at every cw RF power tested.

The inventors believe that the increased efficiency of the glass tube antenna structure of the present invention may result from the thick dielectric layers of the tube, which prevents arcing and sparking at high RF powers.

Additionally, in some cases the RF resistance of the present invention may be lower than comparable porcelain coated antennas, further increasing the efficiency at high RF currents.

The antenna of the present invention is long-lived under both cw and pulsed high-power operating conditions. The antenna has been operated with several different plasma gases at high power levels. In one experiment, the glass antenna was operated with Argon as the feeding gas at a RF power of 1.8 kW for over 85 hours. No physical damage was seen in the glass tubing or wire. However, porcelain antennas operated under at the same RF power for 50 hours can have physical damage to the porcelain coating. In another experiment, no significant degradation was observed after the glass tube antenna was operated in an oxygen plasma for more than 15 hours. This is superior to prior art porcelain coated antennas that degraded within ten hours under the same operating conditions.

The present invention is also reliable. Catastrophic failure can be defined as the fracture or cracking of the antenna that causes atmospheric gases or coolant to enter the vacuum chamber. Catastrophic failure of the antenna of the present invention has not been observed, even at the highest power levels. The resilient vacuum feedthrough and shield member of the present invention protects the glass tube from snapping or cracking at a feedthrough. Even at the highest power operation, failure of the vacuum feedthroughs has not been observed. Additionally, the main antenna coil has not been observed to crack or fracture, even at the highest RF powers.

The present invention also prevents catastrophic failure in the event of a sudden loss of coolant during cw operation. The inventors recognize that the dimensions, numbers, and material compositions of the wires can be selected to perform an additional fuse-like function. A failure mode in which individual wires act like fuses is a "soft" failure mode in which the integrity of the vacuum chamber is preserved. This is contrasted to catastrophic failure modes in which the antenna fractures. Catastrophic failure modes not only require replacement of the antenna but may also require: 1) the replacement of other burned-out filaments suddenly exposed to atmosphere (e.g., the filament used to initiate the plasma reaction or those in measurement gauges); 2) regenerating/repairing vacuum pumps suddenly exposed to atmosphere; and 3) possibly cleaning contaminants from the vacuum system (e.g., atmospheric gases, vaporized wire components, or contaminants backstreamed from other parts of the vacuum systems). Thus, constructing the antenna to incorporate a soft failure mode is advantageous in several ways compared to antennas lacking such a mode.

In order to prevent catastrophic failure, wires 116 of strand 114 are selected to perform a fuse-like function at the RF powers of interest for a particular application. In one experiment the inventors deliberately shut off the coolant water during cw operation of the antenna at an RF current corresponding to 100 Amperes. The wires ceased to act as a continuous electrical conducting path in a time period the inventors estimate to be on the order of one second after the coolant flow was terminated. No fracturing or cracking of the glass occurred. The tube 102 remained substantially filled with liquid. No boiling or rapid vaporization of the coolant was observed.

Those skilled in the art are familiar with techniques to calculate the current density and environmental conditions under which a wire of a particular diameter and materials structure acts like a fuse. Typically, conductive elements act like fuses when the heat load created by the operating current is not balanced by heat dissipation such that the conductive element rapidly increases in temperature. This process may occur at a fairly well-defined current density.

A wire will act as a fuse when the wire either melts or breaks such as to create an open circuit. Unfortunately, large diameter copper wires are generally poor fuses because copper alloys have a high melting point (e.g., copper has a melting point of 1,083° C.). This is particularly true given the fact that a large diameter copper wire will tend to heat uniformly along its length. A large diameter wire (e.g., having a diameter greater than 2 mm) used in a glass-tube antenna would be expected to rapidly heat under cw operation if the coolant supply was interrupted. However, it is unlikely that a large diameter copper wire will act as fuse until a substantial length of wire has reached an elevated temperature such that most of the coolant has vaporized. It is likely that a glass tube antenna would crack from high pressure or from the stresses caused by large thermal gradients before a large diameter wire acted like a true fuse.

However, the inventors believe that a small diameter (e.g., less than about 0.3 mm) copper wire may act like a true fuse in a coolant filled glass tube. One factor that favors a small diameter wire acting like a fuse is that it is substantially more likely to break from mechanical forces than a large diameter wire. The force required to break a wire generally decreases with wire diameter such that a slight softening of a small diameter wire at elevated temperatures may cause it to break. For example, a small diameter wire under tension may act like a fuse at high currents if it loses a small fraction of its mechanical strength at elevated temperatures. It may thus be possible to design a small diameter wire that sufficiently weakens such that it breaks if the coolant temperature approaches its boiling point in a substantial portion of tube 102.

Additionally, it may be possible to design a small diameter wire that rapidly breaks in local "hot spots" along the wire. Immediately subsequent to a cessation of coolant flow, it is likely that heat generation will be somewhat non-uniform throughout small regions (e.g., volumes less than 1 cubic millimeter) throughout the tube. For example, there may be an initial 1–10% variation in heat generation rates per unit length along the wires. Commercially available wire strands are not calibrated resistors with a well-calibrated resistance per unit length. Although the nominal value of the wire diameter is selected, it can be expected that the wire diameter will vary along its length according to some normal manufacturing variance (e.g., a 1–10% variation in diameter). Also, in some regions of the tube, wires 116 may be less uniformly distributed than others. Consequently, it is likely that there will be small variations (e.g., 1–20%) in the local heat generation rates in small regions (e.g., volumes less than 1 cubic millimeter) in tube 102. During ordinary cw operation, the continuous flow of coolant maintains a substantially smooth and uniform temperature profile throughout tube 102. However, if the coolant flow ceases, local variations in heat load may create "hot spots" in which the wire temperature and the temperature of the surrounding coolant quickly rises. Some of these hot spots may rapidly reach a temperature exceeding the boiling point of the coolant. Vapor bubbles may begin to nucleate around the hot spots. The initial non-uniformities in temperature are likely to be enhanced by the formation of vapor bubbles around the hot spots of wires 116. As is well known, even a comparatively small vapor bubble is a relatively poor conductor of heat compared with a liquid coolant. Consequently, a relatively small diameter (e.g., comparable to the wire diameter) vapor bubble may substantially insulate hot spots from the remaining coolant. The theoretical equations used to calculate the temperature rise of a heat source are well known to those skilled in the art, but typically involve balancing heat generation rates, heat outflow rates, and the energy changes associated with changing the temperature of the thermal masses of different regions of interest. The thermal mass per unit length of a small diameter wire is low and it has a small cross sectional area available for the conduction of heat along the wire. A vapor bubble is a poor thermal conductor compared to a liquid coolant. Consequently, it is likely that a hot spot along a small diameter wire which is insulated by a vapor bubble will rapidly increase in temperature until its temperature substantially exceeds the boiling point of the liquid. As a result of the elevated temperature, the wire will soften in the hot spot. Additionally, there may be large thermal gradients across the wire. The wires are thus likely to preferentially break in the hot spots.

Those skilled in the art could further enhance the fuse-like aspects of the wires of the present invention by utilizing smaller diameter wires that are mechanically weaker and which have a lower thermal conductivity per unit length. A tensile force could be applied to the wires to enhance their tendency to break along local hot spots. Also, the wires could be strategically weakened at selected regions with holes or notches prepared by laser drilling or mechanical scoring. The fuse-like behavior could be selected for a particular application by adjusting the above-desired variables. In particular, the fuse-like behavior could be selected such that during high power cw operation the wires would act like fuses without boiling a substantial volume of the coolant or significantly increasing the pressure on the tube in the event of a coolant failure.

While the present invention has been described with reference to the specific embodiments and elements disclosed, it is understood that other, equivalent embodiments of the invention are possible, and that the practice of the invention is not intended to be limited solely to those embodiments disclosed in this application.

What is claimed is:

1. An antenna capable of operation at a center frequency, comprising:

a generally coil-shaped dielectric element having an outer diameter and an inner diameter; and a plurality of conductive wires disposed in the dielectric element, each of the conductive wires having a conductive corrosion resistant surface;

wherein each of the wires has a diameter less than twenty times the RF skin depth at the center frequency, whereby the thermal characteristics of the antenna are improved.

2. The antenna of claim 1, wherein the combined surface area of the plurality of wires is greater than the surface area of the interior of the dielectric element.

3. The antenna of claim 1, wherein the number of the wires, the diameter of the wires, and the distribution of the wires in the interior of the dielectric element are selected to reduce thermal stresses in the antenna.

4. An antenna capable of operation at a center frequency, comprising:

a generally coil-shaped dielectric element having an outer diameter and an inner diameter; and a plurality of conductive wires disposed in the dielectric element wherein the conductive wires have a conductive corrosion resistant surface;

wherein the diameter of the wires is further selected such that the wires will break during cw operation before a coolant disposed in the dielectric element reaches its boiling point in a substantial volume of the dielectric element.

5. The antenna of the claim 4, wherein a tensile force is applied to the wires to increase the likelihood that they will break at an elevated temperature.

6. An antenna capable of operation at a center frequency, comprising:

a generally coil-shaped dielectric element having an outer diameter and an inner diameter; and a plurality of conductive wires disposed in the dielectric element wherein the conductive wires have a conductive corrosion resistant surface;

wherein the conductive corrosion resistant surface includes at least one metal selected from the group consisting of silver and gold.

7. An antenna assembly for an antenna to be operated at a center frequency in a vacuum system, the antenna comprising:

a generally coil-shaped dielectric element having an outer diameter and an inner diameter and a first end and a second end;

a plurality of corrosion resistant conductive wires disposed generally uniformly in the interior of the dielectric element and defining channels for the flow of a coolant through the interior of the dielectric element;

a mounting plate having an interior and exterior side;

a first resilient vacuum seal feedthrough disposed in the mounting plate through which the first end of the dielectric element extends from the exterior side of the mounting plate; and a second resilient vacuum seal feedthrough disposed in the mounting plate through which the second end of the dielectric element extends from the exterior side of the mounting plate;

wherein each of the wires has a diameter less than twenty times the RF skin depth at the center frequency, whereby the thermal characteristics of the antenna are improved.

8. The antenna of assembly of claim 7, wherein the combined surface area of the plurality of wires is greater than the surface area of the interior of the dielectric element.

9. An antenna assembly for an antenna to be operated at a center frequency in a vacuum system, the antenna comprising:

a generally coil-shaped dielectric element having an outer diameter and an inner diameter and a first end and a second end;

plurality of corrosion resistant conductive wires disposed generally uniformly in the interior of the dielectric element and defining channels for the flow of a coolant through the interior of the dielectric element;

a mounting plate having an interior and exterior side;

a first resilient vacuum seal feedthrough disposed in the mounting plate through which the first end of the dielectric element extends from the exterior side of the mounting plate; and a second resilient vacuum seal feedthrough disposed in the mounting plate through which the second end of the dielectric element extends from the exterior side of the mounting plate;

wherein the diameter of the wires is selected such that the wires will break during cw operation before the coolant reaches its boiling point in a substantial volume of the dielectric element.

10. The antenna assembly of claim 9 wherein the number of the wires, the diameter of the wires, and the distribution of the wires in the interior of the dielectric element are selected to reduce thermal stresses in the antenna.

11. An antenna assembly for an antenna to be operated at a center frequency in a vacuum system, the antenna comprising:

a generally coil-shaped dielectric element having an outer diameter and an inner diameter and a first end and a second end;

a plurality of corrosion resistant conductive wires disposed generally uniformly in the interior of the dielectric element and defining channels for the flow of a coolant through the interior of the dielectric element, wherein the combined surface area of the plurality of wires is greater than the surface area of the interior of the dielectric element and the diameter of the wires is further selected such that the wires will break during cw operation before the coolant reaches its boiling point in a substantial volume of the dielectric element;

a mounting plate having an interior and exterior side;

a first resilient vacuum seal feedthrough disposed in the mounting plate through which the first end of the dielectric element extends from the exterior side of the mounting plate;

a second resilient vacuum seal feedthrough disposed in the mounting plate through which the second end of the dielectric element extends from the exterior side of the mounting plate; and external connectors exterior to the vacuum feedthroughs to provide electrical contacts to the plurality of wires and a flow of coolant through the dielectric element;

wherein the external connectors comprise a shield member, the shield member having a first end and a second end substantially surrounding the end sections of the glass tube extending out from the exterior side of the mounting plate.

12. The antenna assembly of claim 11 further comprising a low-torque coolant supply connector supported by the shield member proximate to the second end of the shield member.

13. The antenna assembly of claim 12, wherein the coolant supply connector comprises a copper tube and an O-ring seal.

14. The antenna assembly of claim 13, wherein the plurality of wires is electrically connected to the copper tube.

* * * * *